United States Patent [19]

Hoshino et al.

[11] Patent Number: 4,457,332

[45] Date of Patent: Jul. 3, 1984

[54] TANK FOR STORAGE OF A SUSPENSION

[75] Inventors: Yonesaku Hoshino, Tokyo; Toshikazu Niwa, Yokohama, both of Japan

[73] Assignee: Mitsubishi Jukogyo Kabushiki Kaisha, Tokyo, Japan

[21] Appl. No.: 365,561

[22] Filed: Apr. 5, 1982

[30] Foreign Application Priority Data

Jun. 15, 1981 [JP] Japan ..... 56-90825

[51] Int. Cl.[3] ..... F16K 49/00

[52] U.S. Cl. ..... 137/334; 137/546; 137/590

[58] Field of Search ..... 137/546, 334, 590

[56] References Cited

U.S. PATENT DOCUMENTS

| | | | |
|---|---|---|---|
| 583,983 | 6/1897 | De La Hunt et al. | 137/546 |
| 1,235,438 | 7/1917 | Chynoweth | 137/546 |
| 2,014,287 | 9/1935 | Newman | 137/546 |
| 4,275,760 | 6/1981 | Kessel | 137/546 |

*Primary Examiner*—A. Michael Chambers

*Attorney, Agent, or Firm*—Wenderoth, Lind & Ponack

[57] ABSTRACT

A structure of a tank for storage of a suspension is improved in that a conical bottom partition wall is disposed in the bottom portion within a cylindrical outer shell of the tank with its lowest point located substantially at the center of the horizontal cross-section of the cylindrical outer shell. An upwardly extending side wall is provided along the circumference of the conical bottom partition wall and is disposed with an appropriate interval spaced from an inner surface of the cylindrical outer shell. A cover consisting of an annular top wall inclined substantially in parallel to the conical bottom partition wall and a downwardly extending side wall is fixedly secured to the inner surface of the cylindrical outer shell so as to cover the upwardly extending side wall with an appropriate interval spaced therefrom. A bent pressure communication chamber, extending from the upper side of the circumferential portion of the conical bottom partition wall to the lower side of the same partition wall, is useful for separating a suspension stored in the tank from a liquid preliminarily filled in the space under the conical partition wall and establishing approximate pressure balance between the upper and lower sides of the conical bottom partition wall. The stored suspension can be conveniently discharged through a discharge pipe extending from the lowest point of the conical bottom partition wall to the outside of the cylindrical outer shell.

3 Claims, 3 Drawing Figures

TANK FOR STORAGE OF A SUSPENSION

BACKGROUND OF THE INVENTION

1. Field of the Invention

The present invention relates to a tank for storage of a suspension containing ingredients which may possibly settle or sedimentarily deposit on the bottom thereof.

2. Description of the Prior Art

Recently, a demand for a tank for storage of a suspension containing ingredients which may possibly settle or sedimentarily deposit, such as heavy oil, a mixture of heavy oil and coal, etc., has been abruptly increasing, and development of a tank adapted for storage of the above-described type of suspensions has been desired.

However, a large-sized storage tank in the prior art is generally of flat-bottomed upright cylindrical shape, and hence it has a disadvantage that is a suspension containing ingredients which may possibly settle or sedimentarily accumulate is stored in such a tank, the sedimentary material would accumulate on the bottom of the tank, resulting in reduction of an effective storage volume of the tank, and moreover if the accumulated material is solidified, upon discharging the tank a lot of labor and time are necessitated for removing the accumulated material. The present invention has been worked out under the above-mentioned technical background.

SUMMARY OF THE INVENTION

It is therefore one object of the present invention to provide a tank adapted for storage of a suspension containing ingredients which may settle or sedimentarily accumulate.

According to one feature of the present invention, there is provided a tank for storage of a suspension comprising a flat-bottomed upright cylindrical outer shell, an inclined bottom partition wall of conical shape disposed in the bottom portion within said outer shell with its lowest point located substantially at the center of the horizontal cross-section of said cylindrical outer shell, an upwardly extending side wall provided along the circumference of said inclined bottom partition wall being disposed with an appropriate interval spaced from an inner surface of said cylindrical outer shell, and a cover consisting of an annular top wall inclined substantially in parallel to said inclined bottom partition wall and a downwardly extending side wall, which cover is fixedly secured to the inner surface of said cylindrical outer shell so as to cover said upwardly extending side wall with an appropriate interval spaced therefrom, whereby a bent pressure communication chamber extending from the upper side of the circumferential portion of said inclined bottom partition wall to the lower side of the same partition wall can be formed.

Since the tank for storage of a suspension according to the present invention has the above-mentioned structure, it has such versatility that the tank can be easily constructed by employing the heretofore practically used tank of flat-bottomed upright cylindrical shape as a basic structure and additionally providing simple members without making any special reconstruction of the basic tank structure. Also, since an inclined bottom partition wall of conical shape is disposed in the bottom portion within the cylindrical outer shell with its lowest point located substantially at the center of the horizontal cross-section of the outer shell, the settled or sedimentarily accumulated material is made to flow in itself to the lowest point to be collected before solidification thereof begins to occur by making use of the inclined bottom partition wall, and thereby the settled or sedimentarily accumulated material can be extracted simultaneously with discharge of the stored liquid. Therefore, the tank according to the present invention is a tank adapted for storage of a suspension in which stagnation of a settled or sedimentarily accumulated material in the bottom portion within a tank would not occur.

Furthermore, in the tank for storage of a suspension according to the present invention, since a bent pressure communication chamber extending from the upper side of the circumferential portion of the inclined bottom partition wall to the lower side of the same partition wall can be formed by the upwardly extending side wall provided along the circumference of the inclined bottom partition wall, the cover and the inner surface of the cylindrical outer shell, when a liquid that would not bring about any disadvantage due to settling or sedimentary accumulation and that would not bring about any special inconvenience even if it should mix with the stored suspension (for instance, heavy oil in the case where the stored suspension is a coal-oil-mixture (COM), or water in the case where it is a suspension employing water as a solvent), is preliminarily filled in the space between the flat bottom of the tank outer shell itself and the inclined bottom partition wall, the hydraulic pressure in the stored suspension is transmitted through the air trapped in the pressure communication chamber to the liquid filled in the space, so that the hydraulic pressures acting upon the upper and lower surface, respectively, of the inclined bottom partition wall can be balanced or can have a minimum pressure difference. Therefore, the inclined bottom partition wall would not be damaged or deformed. Hence the material for the inclined bottom partition wall can be saved, and the expense for construction of the storage tank can be reduced.

Still further, in the tank for storage of a suspension according to the present invention, because of the above-mentioned construction, it is possible to provide heating means in the space between the flat bottom of the tank outer shell itself and the inclined bottom partition wall and to facilitate discharging of the stored suspension by indirectly heating the stored suspension through heating of the liquid filled in the space with the heating means. At that moment, the increment of the volume of the liquid filled in the space caused by heating can be well absorbed by expansion and compression of the air confined in the pressure communication chamber. Therefore, no inconvenience would arise in the tank as a result of the heating.

BRIEF DESCRIPTION OF THE DRAWINGS

The above-mentioned and other objects, features and advantages of the present invention will become more apparent by reference to the following description of one preferred embodiment of the invention taken in conjunction with the accompanying drawings, wherein.

DETAILED DESCRIPTION OF THE PREFERRED EMBODIMENT

Now one preferred embodiment of the present invention will be described in greater detail with reference to FIGS. 1 to 3 of the drawings.

Figure 1:
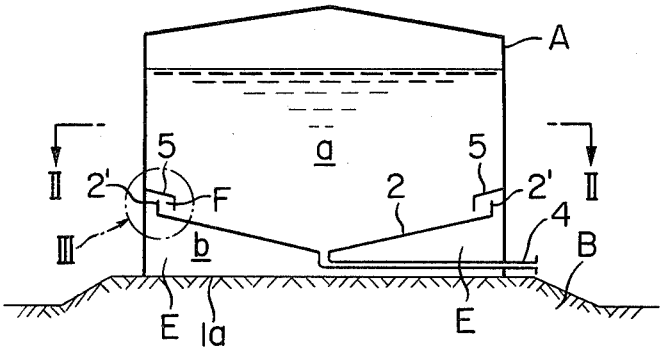
FIG. 1 is a schematic longitudinal cross-section view showing a general structure of a tank for storage of a suspension according to one preferred embodiment of the present invention.

Referring to FIG. 1 which shows a general structure of a tank according to one preferred embodiment of the present invention, reference character (A) designates an upright cylindrical tank having a flat bottom (1*a*), which is constructed on the ground (B), and this tank (A) is available for storage of a suspension containing ingredients which may possibly settle or sedimentarily accumulate.

In the bottom portion of the tank (A) is disposed an inclined bottom partition wall (2) of conical shape with its lowest point located substantially at the center of the horizontal cross-section of the tank (A), a space (E) is formed between the inclined bottom partition wall (2) and the flat bottom (1*a*) of the tank (A). There is provided a discharge pipe (4) for a stored suspension (a) which extends from the proximity of the lowest point of the inclined bottom partition wall (2) and penetrates a side wall (1), referenced in only FIGS. 2 and 3, of the tank (A).

Figure 2:
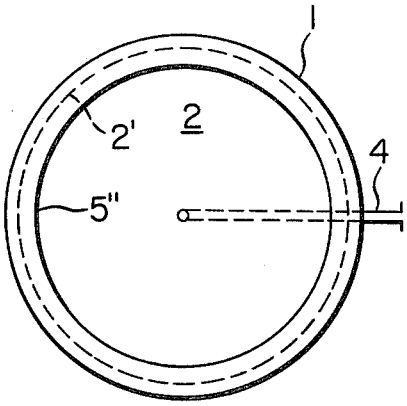
FIG. 2 is a cross-section plan view taken along line II—II in FIG. 1 as viewed in the direction of arrows.
Figure 3:
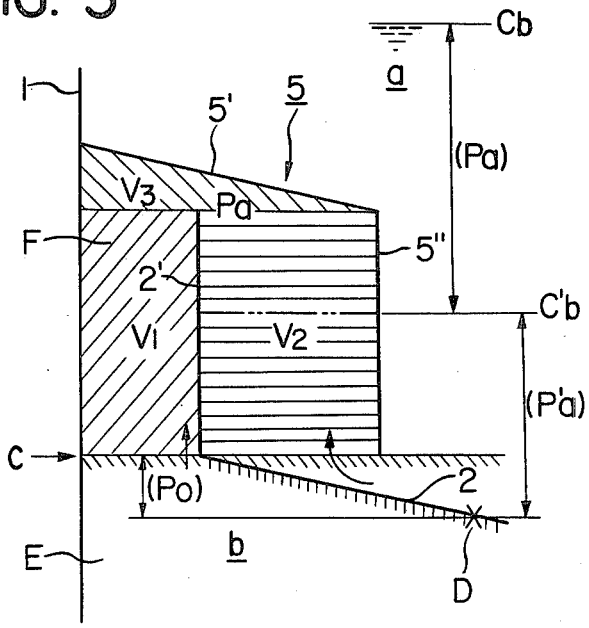
FIG. 3 is an enlarged partial cross-section view for the portion encircled by a dash-dot line III in FIG. 1.

In addition, as shown in FIGS. 2 and 3, a short cylindrical upward side wall (2') extending in the upward direction is provided along the circumference of the inclined bottom partition wall (2). The upwardly extending side wall (2') is disposed with an appropriate interval spaced from the side wall (1) of the tank (A). Also, a cover (5) consisting of an annular top wall (5') and a short cylindrical downward side wall (5'') extending downwardly from the inner circumference of the annular top wall (5') is fixedly secured to the inner surface of the side wall (1) of the tank (A) with an appropriate interval spaced between the top wall (5') of the cover (5) and the top edge of the upwardly extending side wall (2'), between the downwardly extending side wall (5'') of the cover (5) and the upwardly extending side wall (2') and between the bottom edge of the downwardly extending side wall (5'') and the inclined bottom partition wall (2), so that the upwardly extending side wall (2') of the inclined bottom partition wall (2) may be covered by the cover (5), and thereby a bent pressure communication chamber (F) for communicating the upper side of the circumferential portion of the inclined bottom partition wall (2) with the space (E) formed on the lower side of the inclined bottom partition wall (2), is provided. It is to be noted that the top wall (5') of the cover (5) and the inclined bottom partition wall (2) are inclined so that a sediment of the stored suspension (a) within the tank (A) may be forced to flow towards the lowest point, and thereby accumulation of the sediment on a substantial area of these members can be prevented.

In the illustrated embodiment, since the tank (A) has the above-described construction, when the tank (A) is used for storage of a suspension, a liquid (b) that would not bring about any disadvantage due to settling or sedimentary accumulation and that would not bring about any special inconvenience even if it should mix with the stored suspension (a) is preliminarily filled in the space (E) before charging the tank (A) with a suspension (a) to be stored, and thereafter the suspension or storage liquid (a) is received on the inclined bottom partition wall (2).

As the storage liquid (a) is gradually increased in volume, when it has reached the bottom edge of the downwardly extending side wall (5''), the air within the pressure communication chamber (F) formed inside of the cover (5) is sealed off, so that the hydraulic pressures of the stored suspension (a) and the liquid (b), respectively, are transmitted to each other via the confined air.

Accordingly, with regard to the hydraulic pressure applied to the inclined bottom partition wall (2), if the level of the stored suspension (a) comes above the bottom edge of the downwardly extending side wall (5'') of the cover (5), then the hydraulic pressures applied to the upper and lower surfaces, respectively, of the inclined bottom partition wall (2) would be approximately offset by each other. Hence, the hydraulic load upon the inclined bottom partition wall (2) is held to nearly zero. Consequently, damage and or deformation of the inclined bottom partition wall (2) can be prevented, the structural dimensions of the inclined bottom partition wall (2) can be made small, and hence the construction expense of the tank (A) can be greatly reduced.

In the case where the storage liquid (a) is to be stored as heated up, a necessary heat-insulating structure is preliminarily provided in the side wall (1) and the roof of the tank (A), and/or a heater is provided therein (not shown). It is also possible to provide a heater within the space (E) in the bottom portion of the tank (A) and to indirectly heat the storage liquid (a) by heating the liquid (b) filled in the space (E) with the heater. Hence it becomes unnecessary to dispose a heater on the surfaces where accumulation of a sediment would arise in the bottom portion of the tank (A), and such surfaces can be held flat and smooth to assist flowing down of the sediment. In addition, the heating of the storage liquid (a) in the bottom portion of the tank (A) has an effect of promoting the flow of the storage liquid (a) as well as the flow and discharge of the sediment.

The various dimensions of the pressure communication chamber (F) are determined such that the volume change of the liquid (b) caused by the heating in the bottom portion may be absorbed by the volume portion ($V_1$) in FIG. 3. The volume portion ($V_2$) is a space for allowing the storage liquid (a) to enter therein in response to a volume change of the sealed air which originally occupied the volume ($V_1+V_2+V_3$) due to compression by the environmental hydraulic pressure, and the volume portion ($V_3$) serves as an air space for preventing the liquid (b) and the storage liquid (a) from contacting with each other in the pressure communication chamber (F).

Now it is assumed that the level of the liquid (b) in the space (E) is at a level C, and the level of the storage liquid (a) is also at the same level C where the surface of the storage liquid (a) has just reached the bottom edge of the downwardly extending side wall (5'') of the cover (5). Also, it is assumed that, as a result of subsequent charging of the storage liquid (a), the level of the storage liquid (a) has risen up to a level denoted by $C_b$, whereas the level of the liquid (b) is maintained at the same level (C) taking into account the thermal expansion of the liquid (b) caused by the heating, although it must be slightly lowered due to an increase of a pressure of the air sealed within the pressure communication chamber (F) if the heating of the liquid (b) is not done.

Then the decrease $\Delta V_2$ of the volume portion ($V_2$), which decrease corresponds to the volume of the storage liquid (a) entering into the pressure communication chamber (F) inside of the cover (5), can be calculated in the following manner.

If the level of the storage liquid (a) within the pressure communication chamber (F), that is, within the volume portion ($V_2$) is denoted by ($C'_b$), the hydraulic pressure in atmospheres (atms) caused by the column of the storage liquid (a) between the levels ($C_b$) and ($C'_b$) is represented by ($P_a$) and the air pressure above the storage liquid (a) is always kept at 1 atm, then in view of the fact that the air confined in the pressure communication chamber (F) initially had a volume of $V_1+V_2+V_3$ and a pressure of 1 atm but later compressed into a volume of $V_1+V_2+V_3-\Delta V_2$ at a pressure of $(1+P_a)$ atms, the following equation is obtained from Boyle's law that, at a constant temperature, the pressure of a gas is inversely proportional to its volume:

$$\frac{V_1 + V_2 + V_3 - \Delta V_2}{V_1 + V_2 + V_3} = \frac{1}{1 + P_a}$$

hence, $$\Delta V_2 = \left(1 - \frac{1}{1 + P_a}\right)(V_1 + V_2 + V_3)$$
$$= \frac{P_a}{1 + P_a}(V_1 + V_2 + V_3)$$

Therefore, if the horizontal cross-section area of the volume portion ($V_2$) and the specific gravity of the storage liquid (a) are given, the level ($C'_b$) of the storage liquid (a) within the volume portion ($V_2$) can be easily determined from the above equation. At this moment, the hydraulic pressures acting upon the upper and lower surfaces, respectively, of the inclined bottom partition wall (2) at an arbitrary point (D) are:

$P_a+P'_a$ upon the upper surface, and $P_a+P_o$ upon the lower surface, where ($P'_a$) represents a hydraulic pressure caused by a column of the storage liquid (a) between the level ($C'_b$) and the point (D), and ($P_o$) represents a hydraulic pressure caused by a column of the liquid (b) between the level (C) and the point (D). Accordingly, the resultant pressure difference between the upper surface and the lower surface of the inclined bottom partition wall (2) would be equal to ($P'_a-P_o$). Although the value of this pressure difference would vary depending upon the level of the liquid (b) and the difference in a specific gravity between the storage liquid (a) and the liquid (b), it can be made sufficiently small as long as the various dimensions of the pressure communication chamber (F) are appropriately selected.

Since the tank (A) for storage of a suspension (a) according to the present invention is constructed as described above, the additional members consisting of the inclined bottom partition wall (2) and the annular cover (5) can be additionally provided without making any special reconstruction in the heretofore used flat-bottomed upright cylindrical tank. Hence, it is possible to collect a sediment at the lowest position by means of the inclined bottom partition wall (2) and to extract it jointly with a discharged storage liquid (a). Therefore, the tank (A) is most suitable as a storage tank for a stored suspension (a) including settling and sedimentarily accumulating ingredients.

Moreover, since the loads applied to the inclined bottom partition wall (2) due to the hydraulic pressure acting upon the upper and lower surfaces thereof can be nearly offset via the pressure communication chamber (F) by filling the space (E) under the inclined bottom partition wall (2) with a liquid (b), damage and/or deformation of the inclined bottom partition wall (2) would become very little, and so, there is an economical advantage in that the inclined bottom partition wall (2) can be provided with smaller dimensions and thus with less expense.

Still further, by heating the storage liquid (a) above the inclined bottom partition wall (2), the flow of the discharged liquid as well as the flow of the sediment can be promoted, the hence they can be discharged smoothly.

While the present invention has been described above in connection with one preferred embodiment thereof, as a matter of course the invention should not be limited to the illustrated embodiment but various changes and modifications in design could be made without departing from the spirit of the present invention.

What is claimed is:

1. A tank for storage of a suspension comprising:
   - a flatbottomed upright cylindrical outer shell,
   - an inclined bottom partition wall of conical shape disposed in a bottom portion of said outer shell with its lowest point located substantially at the center of a horizontal cross-section of said cylindrical outer shell,
   - an upwardly extending side wall provided along the circumference of said inclined bottom partition wall being disposed with a first predetermined interval spaced from an inner surface of said cylindrical outer shell,
   - a cover including an annular top wall portion inclined substantially in parallel to said inclined bottom partition wall and also including a downwardly extending side wall,
   - said cover being fixedly secured to an inner surface of said cylindrical outer shell so as to cover said upwardly extending side wall with a second predetermined interval spaced between said downwardly extending side wall and said upwardly extending side wall, said first predetermined interval and said second predetermined interval allowing fluid communication around said inclined bottom partition wall, and
   - a bent pressure communication chamber extending from an upper side of the inclined bottom partition wall around said upwardly extending side wall to a lower side of the same inclined bottom partition wall.

2. A tank for storage of a suspension as claimed in claim 1 further comprising:
   - a discharge pipe for the stored suspension, said pipe extending from the lowest point of said inclined bottom partition wall to the outside of said cylindrical outer shell.

3. A tank for storage of a suspension as claimed in claim 1, further comprising:
   - a heat-insulating structure associated with said flat-bottomed upright cylindrical outer shell, and
   - heating means disposed within a space under said inclined bottom partition wall within said cylindrical outer shell,
   - whereby the stored suspension can be indirectly heated by heating the liquid filled in said space under said inclined bottom partition wall with said heating means.

* * * * *